US009944083B2

(12) United States Patent
Zhao

(10) Patent No.: US 9,944,083 B2
(45) Date of Patent: Apr. 17, 2018

(54) PRINTING HEAD CLEANING DEVICE

(71) Applicant: BOE TECHNOLOGY GROUP CO., LTD., Beijing (CN)

(72) Inventor: Dejiang Zhao, Beijing (CN)

(73) Assignee: BOE TECHNOLOGY GROUP CO., LTD. (CN)

( * ) Notice: Subject to any disclaimer, the term of this patent is extended or adjusted under 35 U.S.C. 154(b) by 0 days.

(21) Appl. No.: 15/321,126

(22) PCT Filed: Mar. 18, 2016

(86) PCT No.: PCT/CN2016/076689
§ 371 (c)(1),
(2) Date: Dec. 21, 2016

(87) PCT Pub. No.: WO2016/169372
PCT Pub. Date: Oct. 27, 2016

(65) Prior Publication Data

US 2017/0151791 A1 Jun. 1, 2017

(30) Foreign Application Priority Data

Apr. 22, 2015 (CN) ..... 2015 1 0191963

(51) Int. Cl.
*B41J 2/165* (2006.01)

(52) U.S. Cl.
CPC ..... *B41J 2/16552* (2013.01); *B41J 2/16517* (2013.01)

(58) Field of Classification Search
CPC ..... B41J 2/16552
See application file for complete search history.

(56) References Cited

U.S. PATENT DOCUMENTS 8,262,195 B2 9/2012 Maida et al.
2004/0233265 A1* 11/2004 Kojima ..... B41J 2/01 347/102
2007/0252863 A1* 11/2007 Sun ..... B41J 2/16552 347/28
2008/0303857 A1* 12/2008 Youn ..... B08B 3/04 347/28
2009/0315940 A1* 12/2009 Chun ..... B41J 2/16517 347/22
2011/0193913 A1* 8/2011 Cho ..... B41J 2/16535 347/25

(Continued)

FOREIGN PATENT DOCUMENTS

CN 1840341 A 10/2006
CN 101616805 A 12/2009
CN 102602152 A 7/2012

(Continued)

OTHER PUBLICATIONS

Chinese First Office Action for Chinese Application No. 201510191963.9 dated Nov. 16, 2015, 6 Pages.

(Continued)

*Primary Examiner* — Shelby Fidler
(74) *Attorney, Agent, or Firm* — Brooks Kushman P.C.

(57) ABSTRACT

The present disclosure provides a printing head cleaning device, comprising a cleaning unit configured to spray cleaning liquid onto a nozzle of a printing head so as to clean the nozzle; and a drying unit configured to dry the cleaned nozzle.

18 Claims, 4 Drawing Sheets

(56) References Cited

U.S. PATENT DOCUMENTS

| | | | | |
|---|---|---|---|---|
| 2012/0186606 | A1* | 7/2012 | Barss | B41J 2/16552 134/26 |
| 2016/0009094 | A1* | 1/2016 | Kawakami | B41J 2/16552 347/25 |

FOREIGN PATENT DOCUMENTS

| | | | |
|---|---|---|---|
| CN | 102649362 | A | 8/2012 |
| CN | 104772989 | A | 7/2015 |
| JP | 2002178529 | A | 6/2002 |
| JP | 2014168896 | A | 9/2014 |
| TW | 200918334 | A | 5/2009 |

OTHER PUBLICATIONS

Chinese Second Office Action for Chinese Application No. 201510191963.9, dated Feb. 6, 2016, 4 Pages.
International Search Report and Written Opinion for Application No. PCT/CN2016/076689, dated Mar. 18, 2016, 13 Pages.

* cited by examiner

PRINTING HEAD CLEANING DEVICE

CROSS-REFERENCE TO RELATED APPLICATIONS

This application is the U.S. national phase of PCT Application No. PCT/CN2016/076689 filed on Mar. 18, 2016, which claims priority to Chinese Patent Application No. 201510191963.9 filed on Apr. 22, 2015, the disclosures of which are incorporated in their entirety by reference herein.

TECHNICAL FIELD

The present disclosure relates to the field of liquid crystal technology, in particular to a printing head cleaning device.

BACKGROUND

For an Organic Light-Emitting Diode (OLED) product, a film-forming method mainly includes evaporation and ink-jet printing. The latter has attracted more and more attentions by manufacturers due to such advantages as shorter tact time and fewer desired materials. Similar to a traditional dot matrix printer, an ink-jet printing device may print an OLED material onto a back plate through a printing head. However, in use, the printing head may be contaminated or a droplet of the OLED material may be attached onto a surface of the printing head, so a surface performance of the printing head may be degraded. In this regard, the spraying of a droplet of a film-forming material from a nozzle in the printing head may be adversely affected, and an overall characteristic of the droplet may be changed. To be specific, the droplet may be fallen onto the back plate at a wrong position, or a satellite droplet may occur (i.e., a small portion of the entire droplet may be fallen onto the back plate outside a desired position), or the droplet on the back plate may become fuzzy. In addition, before the use, it is required to align the printing head. In the case that there is a contaminant particle on the nozzle, the droplet of the film-forming material may not be fallen onto the back plate at the desired position after the alignment.

In order to prevent a spraying effect of the film-forming material from being adversely affected by the contaminated nozzle, one effective method is to clean the printing head and the nozzle. In the related art, a method for cleaning the nozzle of the printing head mainly includes spraying the film-forming material, e.g., the OLED material, for the ink-jet printing through the printing head so as to remove the contaminant, and then wiping the nozzle with a cleaning fabric. However, in the case of wiping the nozzle of the printing head with the cleaning fabric, the nozzle may be damaged. In addition, some other matters may also be attached onto the cleaning fabric, and during the wiping, fibers of the cleaning fabric may also be attached onto the nozzle, resulting in secondary contamination. Hence, it is unnecessary to essentially improve the spraying effect of the nozzle.

SUMMARY

An object of the present disclosure is to provide a printing head cleaning device, so as to effectively clean a printing head.

The present disclosure provides in some embodiments a printing head cleaning device, including: a cleaning unit configured to spray cleaning liquid onto a nozzle of a printing head, so as to clean the nozzle; and a drying unit configured to dry the cleaned nozzle.

Optionally, the cleaning unit includes a cleaning liquid spraying tube and the drying unit includes an air knife.

Optionally, the printing head cleaning device further includes a printing head accommodation case provided with an opening and configured to receive the printing head, the cleaning unit and the drying unit in the case of cleaning the printing head.

Optionally, the accommodation case includes an inner housing and an outer housing. The outer housing includes a top surface provided with an opening, lateral surfaces and a bottom surface, and the bottom surface of the outer housing is arranged at a side opposite to the opening of the printing head accommodation case. The inner case includes a top surface provided with an opening, lateral surfaces and a bottom surface, the opening of the printing head accommodation case is provided in the opening of the top surface of the inner housing, and the bottom surface of the inner housing is arranged at the side opposite to the opening of the printing head accommodation case. A gap is provided between the lateral surface of the outer housing and the lateral surface of the inner housing, and between the bottom surface of the outer housing and the bottom surface of the inner housing.

Optionally, the accommodation case includes an inner housing and an outer housing. The outer housing includes a top surface provided with an opening, lateral surfaces and a bottom surface, and the bottom surface of the outer housing is arranged at a side opposite to the opening of the printing head accommodation case. The inner housing includes a bottom surface arranged at the side opposite to the opening of the printing head accommodation case. A gap is provided between the bottom surface of the outer housing and the bottom surface of the inner housing.

Optionally, a plurality of holes is arranged in the bottom surface of the inner housing, and the cleaning unit, the drying unit and the printing head are accommodated within an accommodation space formed by the lateral surface and the bottom surface of the inner housing during the cleaning process.

Optionally, a rail configured to carry the cleaning unit and the drying unit is arranged on the bottom surface of the inner housing.

Optionally, the cleaning liquid spraying tube includes at least one circular, slit-like or rectangular cleaning liquid outlet.

Optionally, the cleaning liquid spraying tube includes a plurality of cleaning liquid outlets.

Optionally, the printing head cleaning device further includes: a driving control mechanism configured to move the cleaning unit and the drying unit to a position of a target nozzle on the printing head; a rotation control mechanism configured to control a spraying direction of the cleaning liquid from the cleaning unit and a blowing direction of the drying unit based on the position of the target nozzle on the printing head; and a pressure control mechanism configured to control a spraying pressure of the cleaning liquid from the cleaning unit and a blowing pressure of the drying unit.

Optionally, the blowing direction forms an angle of 30° to 60° relative to a plane where a liquid outlet of the target nozzle is located.

Optionally, the air knife includes an air knife body fixed onto a bracket of the drying unit in such a manner that the knife body is rotatably adjustable. The air knife body includes an air-knife face provided with at least one slit-like, width-adjustable air outlet.

Optionally, the lateral surface and the bottom surface of the inner housing are each mesh-like, and the cleaning unit, the drying unit and the printing head are accommodated within an accommodation space formed by the lateral surface and the bottom surface of the inner housing during the cleaning process.

Optionally, the bottom surface of the inner housing is mesh-like, and the cleaning unit, the drying unit and the printing head are accommodated within an accommodation space formed by the bottom surface of the inner housing and the lateral surface of the outer housing during the cleaning process.

Optionally, a rail configured to carry the cleaning unit and the drying unit is arranged on the bottom surface of the inner housing.

Optionally, the rail is arranged along an edge of the bottom surface of the inner housing, and the cleaning unit and the drying unit are movable along the rail.

Optionally, a plurality of holes is arranged in the lateral surface of the inner housing.

Optionally, the printing head cleaning device further includes a pedestal, and the driving control mechanism, the rotation control mechanism and the pressure control mechanism are arranged in the pedestal.

Optionally, the pedestal is hermetically sealed.

According to the embodiments of the present disclosure, the printing head cleaning device may be used to clean the film-forming device for a liquid crystal product or any other similar electronic product, so as to remove a droplet of a film-forming material or any other contaminant attached onto the nozzle of the film-forming device, thereby to prevent the occurrence of such defects as satellite droplet due to the contaminated nozzle. In addition, as compared with the related art where a cleaning fabric is used, it is able to prevent the nozzle from being contaminated secondarily during the cleaning process or prevent a surface of the printing head from being damaged, thereby to protect the printing head while ensuring an excellent cleaning effect.

DETAILED DESCRIPTION

In order to make the objects, the technical solutions and the advantages of the present disclosure more apparent, the present disclosure will be described hereinafter in conjunction with the drawings and embodiments.

Figure 1:
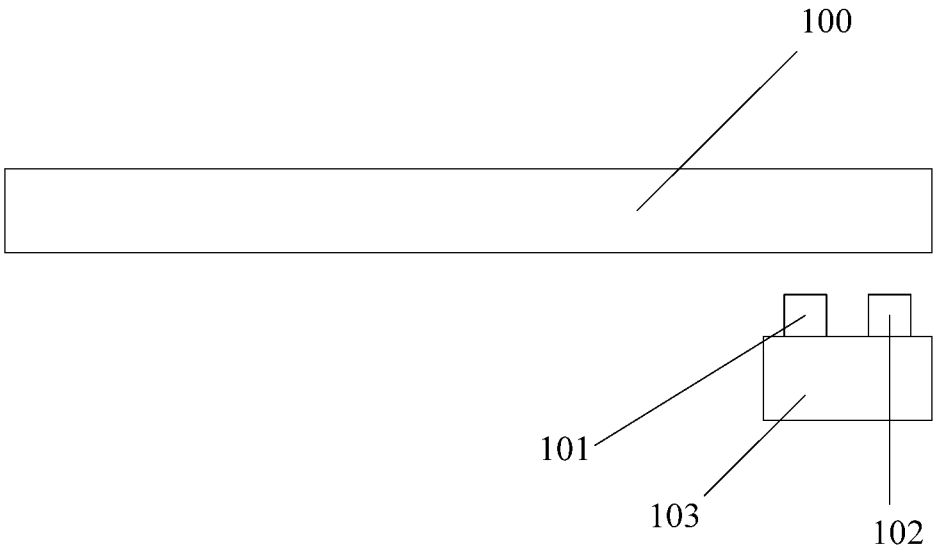
FIG. 1 is a schematic view showing a printing head cleaning device according to one embodiment of the present disclosure.
Figure 2:
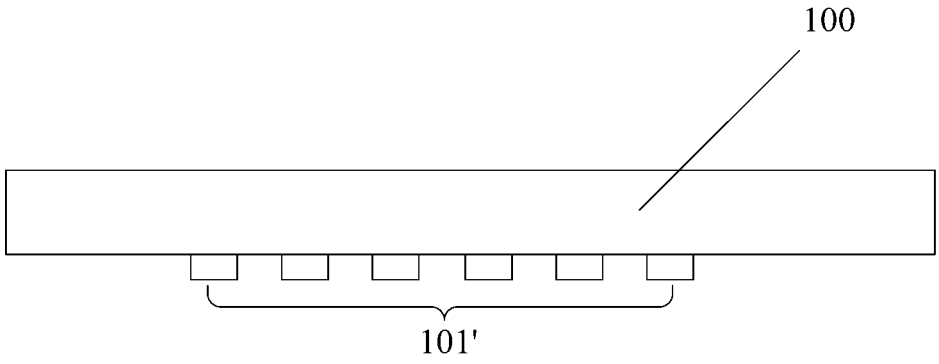
FIG. 2 is a schematic view showing a printing head and nozzles according to one embodiment of the present disclosure.

The present disclosure provides in some embodiments a printing head cleaning device which, as shown in FIGS. 1-2, may include: a cleaning unit 101 configured to spray a cleaning liquid onto a nozzle 101' of a printing head 100, so as to clean the nozzle; and a drying unit 102 configured to dry the cleaned nozzle.

According to the embodiments of the present disclosure, the printing head cleaning device may be used to clean the nozzle of the printing head with the cleaning liquid, and then dry the cleaned nozzle with the drying unit, so as to clean the nozzle in a gentle manner and prevent the performance of the printing head from being adversely affected due to the contaminated nozzle. In addition, during the entire cleaning process, it is unnecessary to use, e.g., a cleaning fabric that may contaminate the nozzle, so it is able to prevent the nozzle from being contaminated secondarily, thereby to ensure a cleaning effect.

To be specific, an air stream may be injected by the drying unit 102 toward the nozzle, so as to remove the remaining cleaning liquid on a surface of the nozzle, and meanwhile clean the nozzle for the second time through moving, by the air stream, the cleaning liquid on the surface of the nozzle.

In some embodiments of the present disclosure, the cleaning liquid may be made of a film-forming matter used for an ink-jet printing device, or any other matter which has a cleaning function and will not result in contamination.

Figure 3:
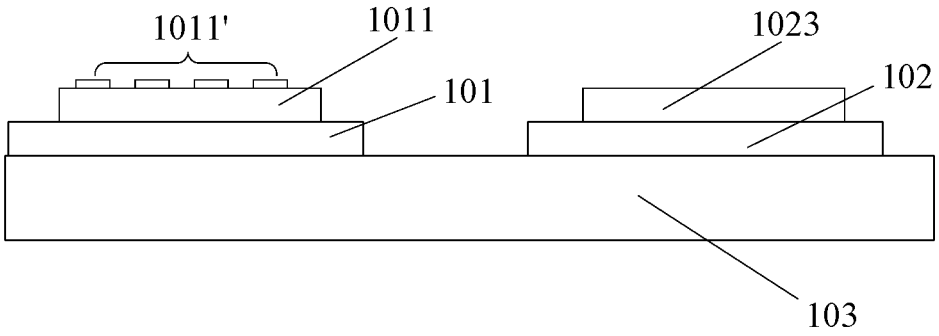
FIG. 3 is another schematic view showing the printing head cleaning device according to one embodiment of the present disclosure.

In some embodiments of the present disclosure, the cleaning unit 101 includes a cleaning liquid spraying tube 1011, and the drying unit 102 includes an air knife 1023. The air knife 1023 may be arranged as shown in FIG. 3.

In some embodiments of the present disclosure, the drying unit 102 may be a mechanism capable of providing the air stream. Optionally, the drying unit 102 may provide the air stream in such a manner as to cover a large area, so as to inject the air stream onto a plurality of nozzles on the printing head 100, thereby to improve the drying efficiency.

Figure 4:
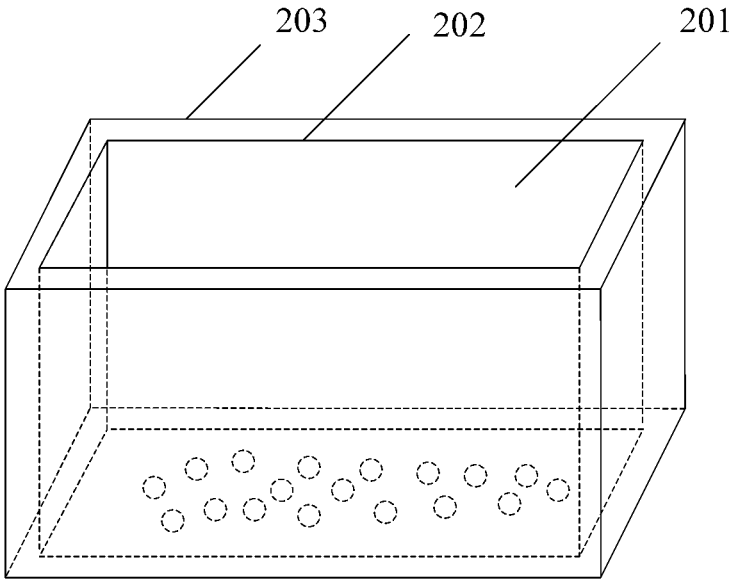
FIG. 4 is a schematic view showing an accommodation case according to one embodiment of the present disclosure.

In some embodiments of the present disclosure, as shown in FIG. 2, the printing head cleaning device may further include a printing head accommodation case provided with an opening and configured to accommodate the printing head, the cleaning unit and the drying unit during the cleaning process. The accommodation case is provided with at least one opening 201. During the cleaning process, the cleaning unit and the drying unit are accommodated in the accommodation case. Then, the printing head is moved through the opening 201 into the accommodation case, so as to clean the printing head. After the printing head is cleaned with the cleaning liquid, the cleaning liquid may be collected by the accommodation case, so as to prevent the cleaning liquid from being in contact with the other parts of an OLED ink-jet printing device when cleaning the printing head, so it is unnecessary to remove the printing head during the cleaning process. In some embodiments of the present disclosure, the accommodation case is provided with at least five surfaces, i.e., a bottom surface and four lateral surfaces, and a top the accommodation case is an opening, as shown in FIG. 4.

In some embodiments of the present disclosure, the accommodation case is provided with six surfaces, and the top surface is provided with an opening during the cleaning process. The top surface is arranged opposite to the bottom surface. In the case that the nozzle needs to be cleaned, it may be moved through the opening 201 in the top surface into the accommodation case, and the cleaning unit and the drying unit are carried on the bottom surface of the accommodation case, so as to clean the nozzle at a level identical or lower than the nozzle.

In some embodiments of the present disclosure, referring to FIG. 4 again, the accommodation case includes an inner housing 202 and an outer housing 203. Among five surfaces of the inner housing 202, a plurality of holes 204 is provided in a surface opposite to the opened surface (i.e., a bottom surface of the inner housing 202). During the cleaning process, the cleaning unit, the drying unit and the printing head may be accommodated within an accommodation space formed by the inner housing.

Figure 5:
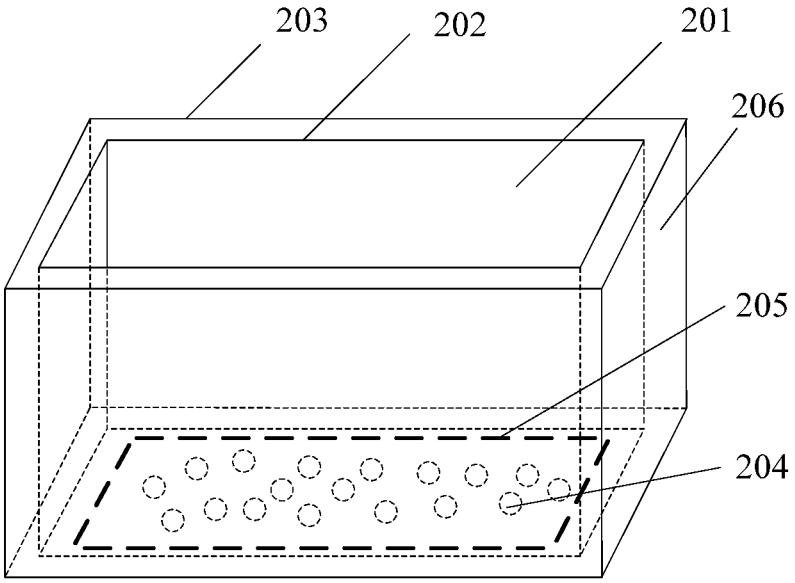
FIG. 5 is another schematic view showing the accommodation case including a rail according to one embodiment of the present disclosure.

In FIG. 2, the inner housing 202 and the outer housing 203 are each provided with five surfaces, so the bottom surface and the lateral surfaces of the accommodation case are each of a double-layered structure. A plurality of holes is provided in the bottom surface of the inner housing 202, and no hole is provided in the bottom surface and the lateral surfaces of the outer housing 203. At this time, the cleaning liquid may not flow out of the accommodation case, and instead, it may flow through the holes in the bottom surface of the inner housing 202 into a gap 206 between the outer housing 203 and the inner housing 202, as shown in FIG. 5.

In some embodiments of the present disclosure, a plurality of holes may also be provided in the lateral surfaces of the inner housing 202. In the case that the droplet of the cleaning liquid is sputtered onto the surfaces of the inner housing, it may be broken into small droplets by the surfaces of the inner housing 202 with the openings, so it is able to prevent the sputtering of the cleaning liquid, i.e., prevent a large droplet from being bounced by a complete surface toward the nozzle. In order to improve an anti-sputtering effect of the inner housing 202, a density of the holes in the surfaces of the inner housing 202 may be increased, i.e., the surfaces of the inner housing 202 may each be of a mesh-like structure.

In some embodiments of the present disclosure, a rail 201 for carrying the cleaning unit and the drying unit may be provided on the bottom surface of the inner housing opposite to the opened surface. The rail 205 may be arranged as shown in FIG. 5.

During the cleaning process, the cleaning unit and the drying unit, which may be controlled through programs, are placed on the rail, so as to clean and dry the target nozzle at a position close to target nozzle. To be specific, each nozzle or each zone of the printing head may be positioned and numbered in advance, and in the case that a certain or some nozzles of the printing head need to be cleaned, a serial number of the nozzle or zone of the printing head may be inputted into the control program, so as to move the cleaning unit and the drying unit to target positions through such a mechanism as an electric motor. In the case that the nozzles are distributed densely on the printing head, the entire printing head may be divided into several zones. An appropriate coordinate position of each zone may be recoded, and each zone may be given with a corresponding serial number. In the case that a nozzle or some nozzles within a certain zone are contaminated, the cleaning unit may be moved to a corresponding position, so as to clean all the nozzles within the zone. The rail may be arranged at an edge of the bottom surface of the inner housing 202. At this time, the cleaning unit and the drying unit may be moved along the circumference of the bottom surface of the inner housing 202, and as a result, a cleaning process and a drying process may not be adversely affected.

In some embodiments of the present disclosure, the outer housing comprises a surface provided with an opening, a bottom surface and lateral surfaces, and the inner housing is merely provided with one surface. The rail for carrying the cleaning unit and the drying unit is provided on a peripheral portion of the inner housing, and the portion of the inner housing other than the peripheral portion is of a mesh-like structure.

To be specific, the printing head cleaning device may further include an indispensible mechanism, e.g., a pedestal which is configured to carry the cleaning unit and the drying unit and to accommodate a driving mechanism for driving the cleaning unit and the drying unit.

In some embodiments of the present disclosure, the cleaning liquid spraying tube is provided with a circular, slit-like or rectangular cleaning liquid outlet.

In some embodiments of the present disclosure, the cleaning liquid spraying tube 1011 is provided with a plurality of outlets 1011', which may be arranged in rows so as to clean a plurality of nozzles simultaneously. In some embodiments of the present disclosure, the outlets 1011' may be arranged as shown in FIG. 3.

In some embodiments of the present disclosure, referring to FIG. 1 again, the printing head cleaning device may further include: a driving control mechanism 104 configured to drive the cleaning unit 101 and the drying unit 102 to a position of the target nozzle on the printing head; a rotation control mechanism 105 configured to control a spraying direction of the cleaning liquid from the cleaning unit 101 and a blowing direction of the drying unit 102 based on the position of the target nozzle on the printing head; and a pressure control mechanism 106 configured to control a spraying pressure of the cleaning liquid from the cleaning unit 101 and a blowing pressure of the drying unit 102.

Figure 6:
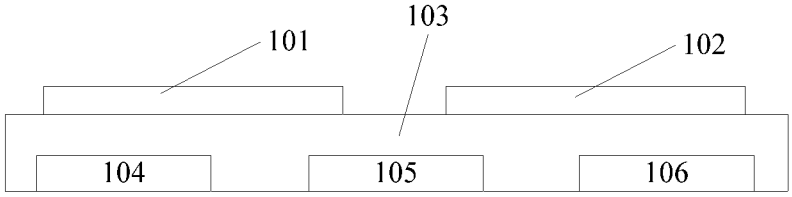
FIG. 6 is yet another schematic view showing the printing head cleaning device according to one embodiment of the present disclosure.
Figure 7:
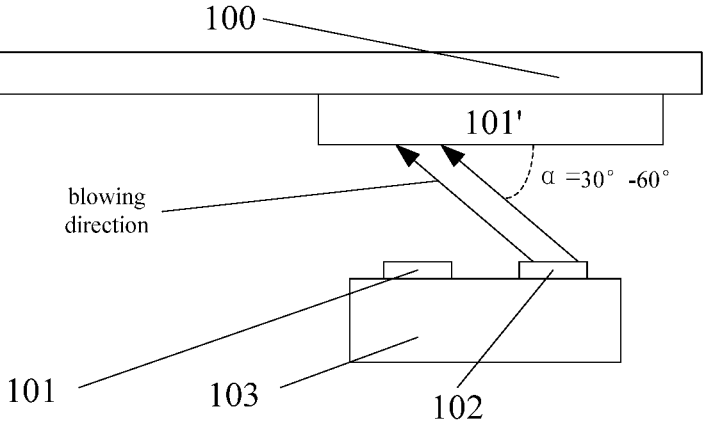
FIG. 7 is a schematic view showing a position relationship between a blowing direction of a drying unit and the nozzle according to one embodiment of the present disclosure.

In some embodiments of the present disclosure, the driving control mechanism 104, the rotation control mechanism 105 and the pressure control mechanism 106 may be arranged as shown in FIG. 6.

The driving control mechanism, the rotation control mechanism and the pressure control mechanism may be arranged within a pedestal 103. The pedestal 103 is hermetically sealed, so as to prevent the cleaning liquid from entering thereinto, thereby to prevent the driving control mechanism, the rotation control mechanism and the pressure control mechanism in the pedestal form being moisturized.

In some embodiments of the present disclosure, the target position is a position of the cleaning unit or the drying unit on the rail corresponding to the target nozzle. During the cleaning process, the cleaning unit and the drying unit may be moved by the driving control mechanism to the target positions corresponding to the target nozzle. Then, the spraying direction of the cleaning unit and the blowing direction of the drying unit, i.e., a direction of an air stream to be injected, may be controlled by the rotation control mechanism. Next, the spraying pressure of the cleaning liquid from the cleaning unit and the blowing pressure of the drying unit, i.e., a pressure of the air stream to be injected, may be controlled by the pressure control mechanism.

In some embodiments of the present disclosure, the blowing direction forms an angle of 30° to 60° relative to a plane where a lower edge of the nozzle is located. To be specific, a plane where a liquid outlet of the nozzle is located is parallel to the plane where the lower edge of the nozzle is located. An air outlet of the drying unit for injecting the air stream is located below the nozzle during the cleaning process, and the blowing direction of the drying unit, i.e., the direction of the air stream to be injected, may form a certain angle with the plane where the lower edge of the nozzle is located, so as to ensure the speed of the air stream and a resultant drying effect, and meanwhile clean the nozzle for the second time through moving, by the air stream, the cleaning liquid on the surface of the nozzle.

Figure 8:
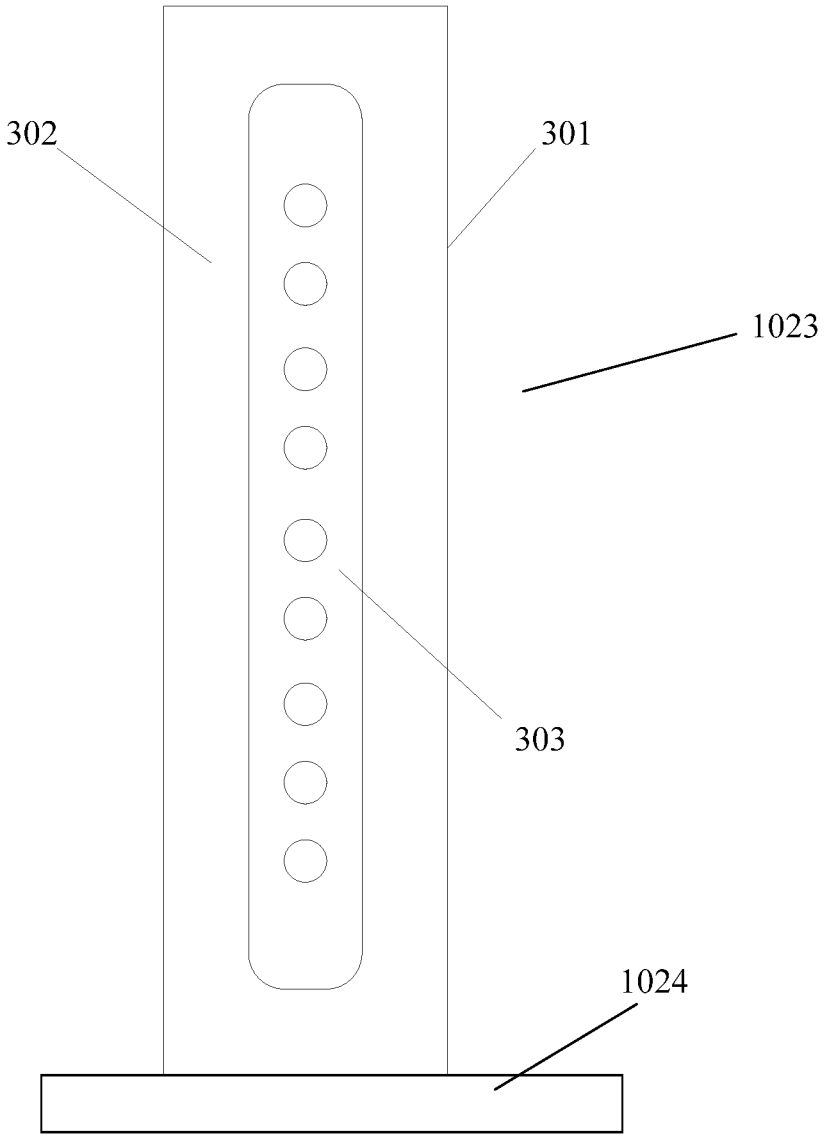
FIG. 8 is a schematic view showing an air knife according to one embodiment of the present disclosure.

In some embodiments of the present disclosure, as shown in FIG. 8, the air knife may include an air knife body 301 fixed onto a bracket 1024 of the drying unit in such a manner that the knife body is rotatably adjustable. The air knife body is provided with an air-knife face 302 provided with at least one slit-like, width-adjustable air outlet 303. The bracket 1024 and the air outlet 303 may be arranged as shown in FIG. 8.

The air knife body 301 may also be provided with a corresponding connection point through which the air knife may be connected to the pedestal of the printing head cleaning device through a connection mechanism. As shown in FIG. 8, the air knife face 302 is arranged at an edge of the air knife body 301.

During the implementation, in the case that, for example, some nozzles on the printing head sprays satellite droplets or fuzzy droplets, or sprays the droplets at wrong positions, the nozzles may be checked to determine whether or not they are plugged. In the case that the nozzles are not plugged, the printing head may be raised to determine whether or not the surface of the nozzle is defective. In the case of the defective surface of the nozzle, the defective nozzle or the zone of the printing head may be cleaned with the cleaning liquid. During the cleaning process, the spraying direction of the cleaning liquid from the cleaning liquid spraying tube may be parallel to, or angled relative to, the surface of the nozzle. The cleaning liquid may be sprayed repeatedly, so as to completely remove the contaminant on the surface of the nozzle. After the cleaning process, the air stream for drying may be delivered by the air knife in a certain direction. Because the nozzle itself is made of a lyophobic material, it is able for the method mentioned herein to readily clean the surface of the nozzle. In addition, after the cleaning process, the ink-jet printing device may be tested so as to determine that the nozzle on the printing head has been cleaned completely, and at this time, the ink-jet printing device may be used normally.

In the case that the printing head cleaning device includes the accommodation case with a rail, the entire cleaning process may include: moving the cleaning unit and the drying unit to a position corresponding to a serial number of the nozzle to be cleaned or a serial number of a zone of the printing head where the nozzle to be cleaned is located; moving the cleaning unit, so as to spray the cleaning liquid in such a direction that the sprayed cleaning liquid may be in contact with the nozzle to be cleaned, and spraying the cleaning liquid at an appropriate spraying pressure from the cleaning unit toward the nozzle to be cleaned; and moving the drying unit, so as to inject the air flow in such a direction that the injected air flow may reach the nozzle to be dried, and injecting the air flow at an appropriate blowing pressure from the drying unit toward the nozzle to be dried.

After the cleaning process and the drying process, the printing head may be moved to a normal operation position.

According to the embodiments of the present disclosure, the printing head cleaning device may be used to clean the film-forming device for a liquid crystal product or any other similar electronic product, so as to remove a droplet of a film-forming material or any other contaminant attached onto the nozzle of the film-forming device, thereby to prevent the occurrence of such defects as satellite droplet due to the contaminated nozzle. In addition, as compared with the related art where a cleaning fabric is used, it is able to prevent the nozzle from being contaminated secondarily during the cleaning process or prevent a surface of the printing head from being damaged, thereby to protect the printing head while ensuring an excellent cleaning effect.

It should be appreciated that, the above-mentioned embodiments are for illustrative and explanatory purposes only, but shall not be used to limit the scope of the present disclosure. In the case of no conflict, the embodiments of the present disclosure and the features therein may be combined in any way.

The above are merely the preferred embodiments of the present disclosure. Obviously, a person skilled in the art may make further modifications and improvements without departing from the spirit of the present disclosure, and these modifications and improvements shall also fall within the scope of the present disclosure.

What is claimed is:

1. A printing head cleaning device, comprising a cleaning unit configured to spray cleaning liquid onto a nozzle of a printing head so as to clean the nozzle, and a drying unit configured to dry the cleaned nozzle;

wherein the printing head cleaning device further comprises a printing head accommodation case provided with an opening and configured to accommodate the printing head, the cleaning unit and the drying unit during a cleaning process;

wherein the printing head accommodation case comprises an inner housing and an outer housing;

the outer housing comprises a top surface provided with an opening, lateral surfaces and a bottom surface, and the bottom surface of the outer housing is arranged at a side opposite to the opening of the printing head accommodation case;

the inner housing comprises a top surface provided with an opening, lateral surfaces and a bottom surface, the opening of the printing head accommodation case is the opening of the top surface of the inner housing, and the bottom surface of the inner housing is arranged at the side opposite to the opening of the printing head accommodation case;

a gap is provided between the lateral surface of the outer housing and the lateral surface of the inner housing, and between the bottom surface of the outer housing and the bottom surface of the inner housing; and a plurality of holes is arranged in the bottom surface of the inner housing.

2. The printing head cleaning device according to claim 1, wherein the cleaning unit comprises a cleaning liquid spraying tube and the drying unit comprises an air knife.

3. The printing head cleaning device according to claim 2, wherein the cleaning liquid spraying tube comprises at least one circular, slit-like or rectangular cleaning liquid outlet.

4. The printing head cleaning device according to claim 3, wherein the cleaning liquid spraying tube comprises a plurality of cleaning liquid outlets.

5. The printing head cleaning device according to claim 2, wherein the air knife comprises an air knife body fixed onto a bracket of the drying unit in such a manner that the knife body is rotatably adjustable, and the air knife body comprises an air-knife face provided with at least one slit-like, width-adjustable air outlet.

6. The printing head cleaning device according to claim 1, wherein the drying unit and the printing head are accommodated within an accommodation space formed by the lateral surface and the bottom surface of the inner housing during the cleaning process.

7. The printing head cleaning device according to claim 6, wherein a rail configured to carry the cleaning unit and the drying unit is arranged on the bottom surface of the inner housing.

8. The printing head cleaning device according to claim 7, wherein the rail is arranged along an edge of the bottom surface of the inner housing, and the cleaning unit and the drying unit are movable along the rail.

9. The printing head cleaning device according to claim 6, wherein a plurality of holes is arranged in the lateral surface of the inner housing.

10. The printing head cleaning device according to claim 1, wherein the lateral surface and the bottom surface of the inner housing are each mesh-like, and the cleaning unit, the drying unit and the printing head are accommodated within an accommodation space formed by the lateral surface and the bottom surface of the inner housing during the cleaning process.

11. A printing head cleaning device comprising:

a cleaning unit configured to spray cleaning liquid onto a nozzle of a printing head so as to clean the nozzle;

a drying unit configured to dry the cleaned nozzle;

a driving control mechanism, configured to move the cleaning unit and the drying unit to a position of a target nozzle on the printing head;

a rotation control mechanism, configured to control a spraying direction of the cleaning liquid from the cleaning unit and a blowing direction of the drying unit based on the position of the target nozzle on the printing head; and a pressure control mechanism, configured to control a spraying pressure of the cleaning liquid from the cleaning unit and a blowing pressure of the drying unit.

12. The printing head cleaning device according to claim 11, wherein the blowing direction forms an angle of 30° to 60° relative to a plane where a liquid outlet of the target nozzle is located.

13. The printing head cleaning device according to claim 11, further comprising a pedestal, and the driving control mechanism, the rotation control mechanism and the pressure control mechanism are arranged in the pedestal.

14. The printing head cleaning device according to claim 11, wherein the pedestal is hermetically sealed.

15. A printing head cleaning device, comprising:

a cleaning unit configured to spray cleaning liquid onto a nozzle of a printing head so as to clean the nozzle;

a drying unit configured to dry the cleaned nozzle; and a printing head accommodation case provided with an opening and configured to accommodate the printing head, the cleaning unit and the drying unit during a cleaning process;

wherein the printing head accommodation case comprises an inner housing and an outer housing;

the outer housing comprises a top surface provided with an opening, lateral surfaces and a bottom surface, and the bottom surface of the outer housing is arranged at a side opposite to the opening of the printing head accommodation case;

the inner housing comprises a bottom surface arranged at the side opposite to the opening of the printing head accommodation case;

a gap is provided between the bottom surface of the outer housing and the bottom surface of the inner housing; and the bottom surface of the inner housing is mesh-like.

16. The printing head cleaning device according to claim 15, wherein the cleaning unit, the drying unit and the printing head are accommodated within an accommodation space formed by the bottom surface of the inner housing and the lateral surface of the outer housing during the cleaning process.

17. The printing head cleaning device according to claim 15, wherein a rail configured to carry the cleaning unit and the drying unit is arranged on the bottom surface of the inner housing.

18. The printing head cleaning device according to claim 17, wherein the rail is arranged along an edge of the bottom surface of the inner housing, and the cleaning unit and the drying unit are movable along the rail.

* * * * *